US005247312A

United States Patent [19]

McClendon

[11] Patent Number: 5,247,312

[45] Date of Patent: Sep. 21, 1993

[54] WIRE CARRIER CLIP FOR DISH ANTENNA

[75] Inventor: James C. McClendon, Austin, Ark.

[73] Assignee: Universal Antenna Manufacturing, Inc., Ward, Ark.

[21] Appl. No.: 823,854

[22] Filed: Jan. 22, 1992

[51] Int. Cl.[5] ..... H01Q 19/12

[52] U.S. Cl. ..... 343/840; 343/912; 343/916; 248/68.1

[58] Field of Search ..... 343/915, 916, 840, 912; 248/65, 68.1

[56] References Cited

U.S. PATENT DOCUMENTS

| | | | |
|---|---|---|---|
| 1,384,437 | 7/1921 | Edelmann | 248/68.1 |
| 4,136,423 | 1/1979 | Sterling | 248/68.1 |
| 4,151,533 | 4/1979 | Vogt | 343/715 |
| 4,570,884 | 2/1986 | Armbruster | 248/68.1 |
| 4,748,450 | 5/1988 | Hines et al. | 343/715 |
| 4,749,999 | 6/1988 | Hayashi | 343/713 |
| 4,766,443 | 8/1988 | Winegard et al. | 343/840 |
| 5,110,074 | 5/1992 | Deguchi | 248/68.1 |

*Primary Examiner*—Michael C. Wimer
*Assistant Examiner*—Hoanganh Le
*Attorney, Agent, or Firm*—Hermann Ivester

[57] ABSTRACT

A wire carrier clip installable onto a dish antenna after the antenna is up and which clip has a slotted leg which will install to the antenna by slipping between the rib and a washer on the back side rib bolt of the antenna and further including a clamping leg with which to sandwich the lead wires between the wire carrier clip and the antenna rib.

2 Claims, 1 Drawing Sheet

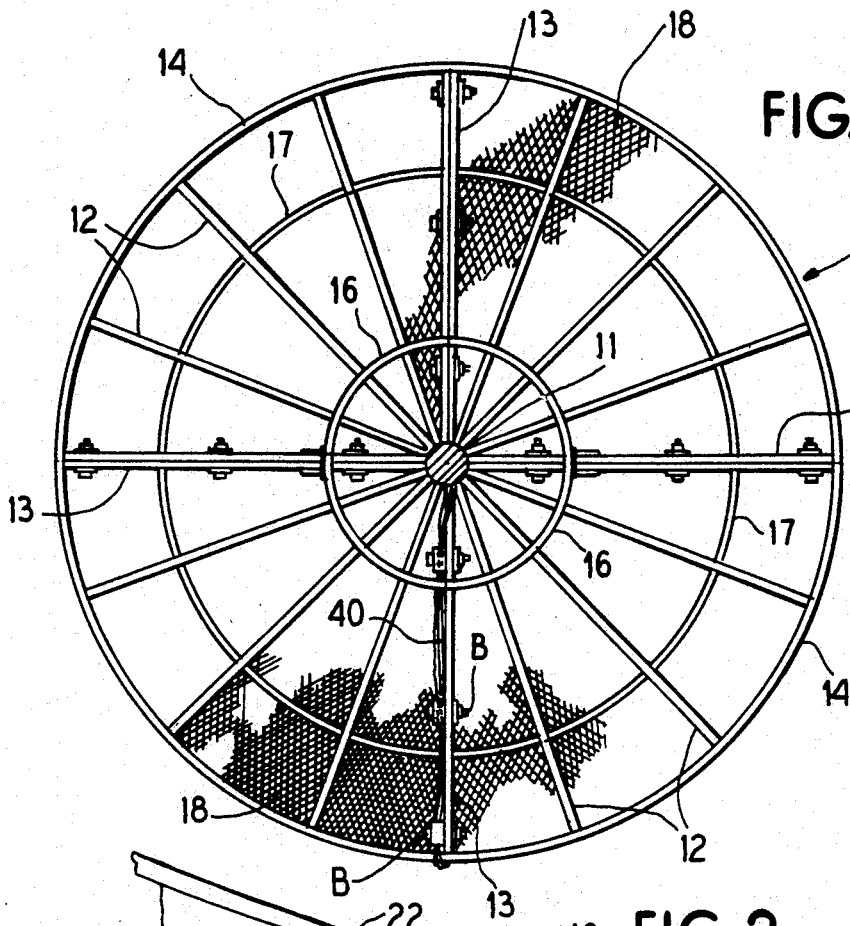
FIG. 1
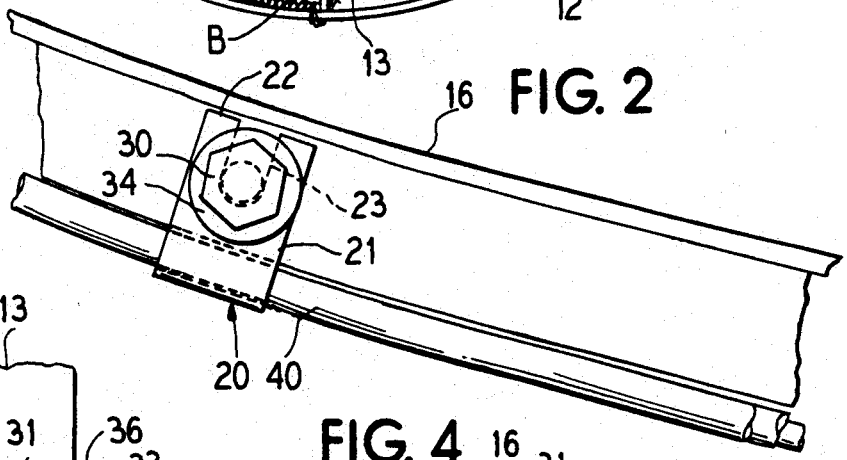
FIG. 2
FIG. 3
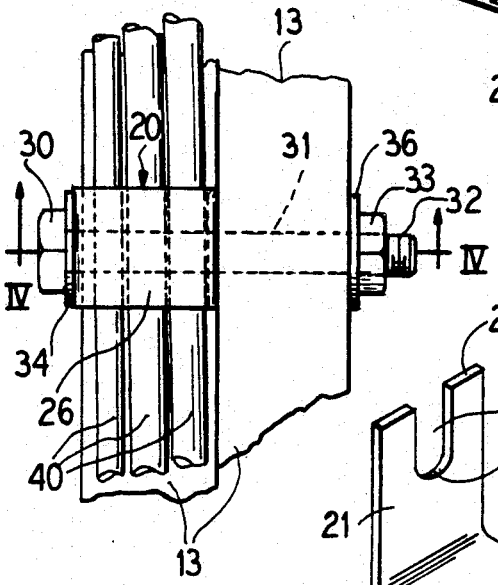
FIG. 4
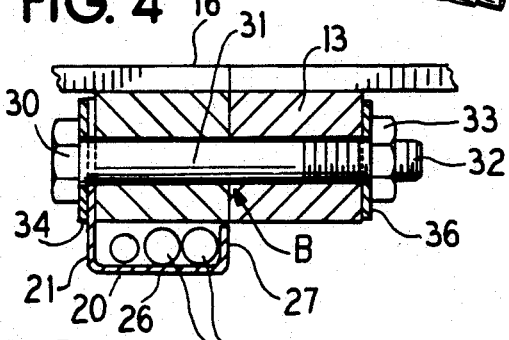
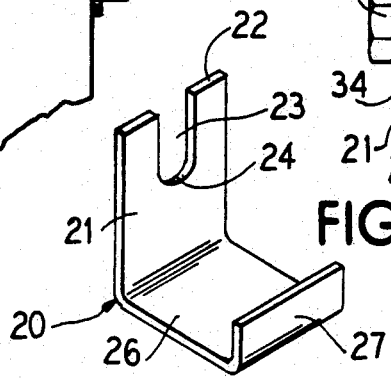
FIG. 5

WIRE CARRIER CLIP FOR DISH ANTENNA

BACKGROUND OF THE INVENTION

1 Field of the Invention

This invention relates to antenna constructions and more particularly to a wire carrier clip for providing an improved method and means for attaching lead wires to the antenna.

2 Description of the Prior Art

Most antenna installations in the home TVRO industry have no means of attaching the receiving cables to the antenna. It is largely left up to the imagination of the installer as how best to attach the antenna lead wires. Most installers use plastic tie wraps to secure the lead wires, drilling holes in the antenna mesh or antenna ribs for attachment.

Tie wraps usually don't last long in the weather conditions of an outside installation. Consequently, important wires are caused to dangle and are left unattached.

SUMMARY OF THE INVENTION

A wire carrier clip is provided which has a long slotted leg and a flanged clamping leg and is designed to be installed after the antenna is up, thereby making it particularly useful in retro-fitting existing installations.

Selected rib bolts on the back side of the antenna are loosened so that a wire carrier clip can be slipped between the rib and the washer on each bolt.

When so positioned, the lead wires can be sandwiched between the clamping leg of the wire carrier clip and the antenna rib. Re-tightening the bolt will insure the attachment of the wire carrier clip and the lead wires to the antenna.

BRIEF DESCRIPTION OF THE DRAWINGS

FIG. 1 is a front view of a typical antenna dish and support frame;

FIG. 2 is an enlarged fragmentary view of a single rib on the backside of the antenna of FIG. 1;

FIG. 3 is an enlarged fragmentary bottom view of the bolted portion of the rib of FIG. 2;

FIG. 4 is a cross-sectional view taken on line IV—IV of FIG. 3;

FIG. 5 is a perspective or isometric view of the wire carrier clip provided in accordance with the present invention.

DESCRIPTION OF THE PREFERRED EMBODIMENTS

Large dish-shaped antennae of the type used for receiving signals from satellite transmitters are typically provided with a mesh-like reflective surface carried in a support frame with a central hub and an outer rim with a mount ring located between the hub and the outer rim. Lead wires must be connected to the antenna for carrying the signals to a point of utilization.

Many installers merely tie the lead wires with plastic tie wraps, drilling holes in the mesh or in the antenna ribs for attachment, which ties frequently deteriorate and consequently the lead wires are oftentimes left dangling and unattached. Consequently, antenna users require an aesthetically satisfactory functionally practical method and means for securing the lead wires to the antenna, which will withstand environmental degradation, is economical and easy to install and which is available and usable for retro-fitting as well as for original equipment installation.

Referring to the drawings, a satellite dish is shown generally at 10 which has a frame comprising a central hub 11, with a plurality of radially extending ribs comprising either single ribs 12, or double ribs 13. The ribs 12 and 13 are connected to an outer peripheral rim 14. A mount ring is shown at 16 and an intermediate ring 17 is disposed between the mount ring 16 and the rim 14. A reflecting surface is formed by a mesh surface member 18.

In typical antenna installations, the dish components are oftentimes made of lightweight aluminum, a form of material that is not particularly resistant to abrasion or to dynamic forces such as those to which the wide-span surfaces of a dish-type antenna may be exposed.

Reinforcement brackets may be mounted to the ribs as shown in the co-pending application owned by the assignee of the present invention, Ser. No. 07/785,472 filed Oct. 31, 1991. Such brackets are attached by means of bolts. In any event, there is provided on the back side of the antenna dish 10 a plurality of bolts such as the bolts B on the double ribs 13.

In accordance with the present invention, it is contemplated that there be provided a wire carrier clip or bracket made of electro-galvanized steel on a spool to minimize waste and to maximize the galvanic protection.

Referring to the drawings, a wire carrier clip is shown at 20 on FIG. 5 wherein the clip is a bracket-like member having a first leg, or an upstanding leg, using the orientation of FIG. 5, identified at 21, and terminating in an edge 22. A slot 23 is formed in the leg 21, entering the leg 21 at the edge 22, and the slot 23 is disposed on the centerline of the leg 21 and is made of a width so as to comfortably accommodate the diameter of a bolt B. The length of the slot 23 is preferably greater than the diameter of the bolts B, for example, one and one half or two times the diameter of the bolts B, and the slot terminates in a curved bight portion 24.

A second leg, or clamping leg, is formed on the clip 20 as shown at 26 and is offset at right angles to the first leg 21 at the end of the leg 21 opposite the edge 22. The clamping leg 26 is flanged as at 27, the flange 27 extending upwardly in the form of a third leg and extending at right angles to the clamping leg 26 and disposed in parallel spaced relation to the leg 21.

The clip 20 can be utilized after the antenna 10 is up, thereby making it ideal for retro-fitting an estimated twenty five million antennas already in service and currently using plastic tie wraps, or nothing at all. Since the clip 20 is slotted at 23, a rib bolt B on the back side of the antenna 10 is loosened to facilitate slipping the clip 20 into place.

Referring to FIGS. 3 and 4, it will be noted that an exemplary bolt B is illustrated as extending through a double rib 13. The bolt B has a head 30, a shank 31 and a threaded end 32 on which is threaded a nut 33. A washer 34 and a washer 36 is disposed inwardly adjacent the head 30 and the nut 33, respectively.

Thus, when the nut 33 is loosened, the edge 22 of the clip is fitted over the shank 31 of the bolt B and the leg 21 of the clip 20 is inserted between the rib 13 and the washer 34.

When so positioned, the clamping leg 26 together with the flange 27 forms together with the adjoining surface of the antenna rib 13 a wiring channel 37 (FIG. 4) in which lead wires 40 for the antenna can be sandwiched. By re-tightening the nut 33 on the bolt B the firm securement of the lead wires 40 to the antenna 10 in an aesthetically pleasing array is insured.

By virtue of the provision thus made, nothing need be disassembled. Appropriate selected bolts B are merely loosened, the wire carrier clips 20 are slid into place and the lead wires 40 are sandwiched between the clamping leg 26 and the antenna rib 13, whereupon the nut and bolt are re-tightened to securely fasten the wires 40 to the antenna 10.

Although minor modifications may be suggested by those versed in the art, it should be understood that I wish to embody within the scope of the patent warranted hereon all such modifications as reasonably and properly come within the scope of my contribution to the art.

I claim as my invention:

1. For use with a dish-type antenna of the type having ribs with bolts on the rear side, a plurality of radial ribs in said antenna;

the improvement of means for attaching lead wires to the antenna and wherein said means more particularly comprise;

a plurality of bolts on the rear side of one of said radial ribs and extending through said one radial rib on the rear side thereof;

a bracket-like wire carrier clip made of galvanized weather resistant material and having first, second and third legs formed theron including, a first leg having a slot opening out of one end thereof and extending inwardly of the leg on the centerline through a dimension of at least two bolt diameters, a second leg offset at the opposite end of said first leg and extending at right angles to said first leg, and a third leg at the end of said second leg and extending at right angles to said second leg in spaced parallel relation to said first leg to form a flange on the second leg;

said first leg being insertable onto a loosened bolt on the rear side of the antenna via said slot;

whereupon the lead wires for connection to the antenna are sandwiched between the adjoining surface of an antenna rib and said second leg; and so that re-tightening the bolt will lock the lead wires in firm assembly with the antenna.

2. A dish antenna comprising:

a hub;

a plurality of radial ribs having front and rear sides and extending outwardly from said hub;

a rim at the outer periphery of the antenna;

a mesh member overlying said radial ribs and said rim and connected thereto to form a reflecting surface for the antenna on the front side of said radial ribs;

means for attaching lead wires to the antenna and wherein said means more particularly comprise:

a plurality of bolts on the rear side of one of said radial ribs and extending through said one radial rib on the rear side thereof, a bracket-like wire carrier clip made of galvanized weather resistant material and having first, second and third legs formed thereon including, a first leg having a slot opening out of one end thereof and extending inwardly of the leg on the centerline through a dimension of at least two bolt diameters, a second leg offset at the opposite end of said first leg and extending at right angles to said first leg, and a third leg at the end of said second leg and extending at right angles to said second leg in spaced parallel relation to said first leg to form a flange on the second leg, said first leg being insertable onto a loosened bolt on the rear side of the antenna via said slot;

whereupon the lead wires for connection to the antenna are sandwiched between the adjoining surface of an antenna rib and said second leg; and so that re-tightening the bolt will lock the lead wires in firm assembly with the antenna.

* * * * *